US009719200B2

(12) United States Patent
Roche et al.

(10) Patent No.: US 9,719,200 B2
(45) Date of Patent: Aug. 1, 2017

(54) QUILT SUSPENSION APPARATUS AND METHOD

(71) Applicant: Great Notions News, Inc., Dallas, TX (US)

(72) Inventors: Eileen Katherine Roche, Flower Mound, TX (US); Dave Jacob Martens, Abbotsford (CA); Marvin Leon Gardner, Dallas, TX (US)

( * ) Notice: Subject to any disclaimer, the term of this patent is extended or adjusted under 35 U.S.C. 154(b) by 0 days.

(21) Appl. No.: 14/953,383

(22) Filed: Nov. 29, 2015

(65) Prior Publication Data

US 2017/0152617 A1 Jun. 1, 2017

(51) Int. Cl.
*D05B 39/00* (2006.01)
*D05B 11/00* (2006.01)

(52) U.S. Cl.
CPC ..... *D05B 11/00* (2013.01); *D05B 39/005* (2013.01)

(58) Field of Classification Search
CPC ..... D05B 11/00; A45F 3/22; A45F 3/24
USPC ..... 112/118, 119
See application file for complete search history.

(56) References Cited

U.S. PATENT DOCUMENTS 142,327 A * 9/1873 Craft ..... A47C 3/0255 5/122
400,699 A * 4/1889 Mandeville ..... D05B 11/00 112/119
591,784 A * 10/1897 Obuch ..... D05B 11/00 112/119
1,175,778 A * 3/1916 Ledford ..... D05B 11/00 112/119
1,186,570 A * 6/1916 Gladney ..... D05B 11/00 112/119
1,212,516 A * 1/1917 Lemons ..... D05B 11/00 112/119
1,244,361 A * 10/1917 Nolan ..... D05B 11/00 112/119

(Continued)

*Primary Examiner* — Danny Worrell
*Assistant Examiner* — Carolyn W Davis
(74) *Attorney, Agent, or Firm* — Hubbard Johnston, PLLC

(57) ABSTRACT

An apparatus and method for suspending a substantial portion of a quilt or fabric for free-motion stitching during sewing operations is disclosed. The apparatus includes a planar frame with support poles extending from the frame feet, with a retainer for retaining a portion of the quilt or fabric attached to one or more support poles via a retainer block. The frame includes at least two frame base portions with frame feet on opposing sides of the frame base portions which form a secure base for the suspension assembly to rest upon a surface. A dowel spans between the frame feet of each frame base and serves to provide a sturdy structural connection to which the support poles are attached. The retention clips retain the quilt or fabric layers in the desired suspended position so as to form a partial paraboloid shape with the local area around the vertex of the partial paraboloid shape positioned in relative juxtaposition to the sewing machine needle where stitching occurs. The frame bases may be moved closer or farther away from each other so as to narrow or enlarge the distance between the support poles attached to each frame foot depending on the size of the table or surface upon which the sewing machine is placed and provides a scalable solution for a variety of stitching or sewing apparatus setups.

5 Claims, 6 Drawing Sheets

(56) References Cited

U.S. PATENT DOCUMENTS

| | | | | | |
|---|---|---|---|---|---|
| 1,675,609 | A * | 7/1928 | Kelley | D05B 11/00 | 112/117 |
| 2,177,720 | A * | 10/1939 | Janssen | D05B 39/005 | 38/102.21 |
| 3,520,260 | A * | 7/1970 | Semilitz | D05B 33/00 | 112/102 |
| 4,704,750 | A * | 11/1987 | Wheelock | A45F 3/22 | 5/120 |
| 4,977,631 | A * | 12/1990 | Bretz | B62D 33/0612 | 267/34 |
| 5,659,906 | A * | 8/1997 | Nickell | A45F 3/24 | 5/120 |
| 6,912,744 | B2 * | 7/2005 | Lyons | A47C 3/0255 | 5/122 |
| 7,996,935 | B1 * | 8/2011 | Chen | A45F 3/22 | 5/120 |
| 8,931,840 | B2 * | 1/2015 | Huang | A45F 3/24 | 297/273 |
| 2015/0101520 | A1 * | 4/2015 | Roche | D05B 75/00 | 112/475.08 |

* cited by examiner

QUILT SUSPENSION APPARATUS AND METHOD

TECHNICAL FIELD

The illustrative embodiments relate generally to free-motion quilting, and more particularly, to an apparatus and method for holding and suspending a quilt or fabric during free-motion quilting or stitching operations conducted on a sewing machine or other quilting or stitching machinery.

BACKGROUND

Decorative quilting and sewing has become increasingly popular over the years. A quilt is typically comprised of two or more fabric layers, a top and bottom layer, stitched together between which an intermediate "batting" layer is positioned. The top layer may include decorative quilt blocks and stitching patterns. The batting layer provides insulation and bulk to the quilt, while the bottom layer typically comprises a fabric complementary to the color and designs presented on the top layer of the quilt. The quilting process typically consists of forming continuous patterns of stitches which extend through the top, batting and bottom layers together with such stitches being generally uniform and tightly spaced together.

Quilting may be accomplished in a variety of ways by either hand or machine stitching. A user may operate a substantially conventional compact sewing machine by removing, lowering or disabling the "feed dogs" so as to operate in a "free-motion" and allow the operator to manually move the quilt or fabric layers relative to the machine needle to produce the desired stitching patterns. While home sewing machines have remained dimensionally compact for ease of storage and portability by the operator, quilts and other bedding fabrics have grown in size from regular twin bed cover sizes to broad area quilts in queen, king and "California" king sizes. Such increased quilting area makes it difficult for an operator to place, move and manipulate the fabric layers to be quilted and stitched with ease when the quilt or fabric layers are draped around and over the table or other surface upon which the sewing machine is placed.

SUMMARY

According to an embodiment, an apparatus for suspending a substantial portion of a quilt or fabric for free-motion quilting or stitching during sewing operations is disclosed, that includes a planar frame with support poles extending from the frame foot, with a retainer attached to one or more support poles via a retainer block. The frame includes at least two frame base portions with frame feet on opposing sides of the frame base portions which form a secure base for the suspension assembly to rest upon a surface. A dowel spans between the frame feet of each frame base and serves to provide a sturdy structural connection to which the support poles are attached. The retention clips retain the quilt or fabric layers in the desired suspension position so as to form a partial paraboloid shape with the local area around the vertex of the paraboloid shape positioned in relative juxtaposition to the sewing machine needle where stitching occurs. The suspension assembly frame bases may be moved closer or farther away from each other so as to narrow or enlarge the distance between the support poles attached to each frame foot depending on the size of the table or surface upon which the sewing machine is placed and provides a scalable solution for a variety of stitching or sewing apparatus setups.

According to another illustrative embodiment, a method for suspending a quilt or fabric for free-motion quilting or stitching during sewing operations is disclosed. The user suspends a portion of the quilt or fabric from one or more retainers attached to one or more support poles which extend vertically from a frame in contact with the floor or another support surface. The retainers secure the quilt or fabric in the desired suspension position so as to form the quilt or fabric into a partial paraboloid shape with the local area surrounding the vertex of the parabolic shape positioned in relative juxtaposition to the sewing machine needle where stitching occurs enabling the operator to easily move the vertex and areas surrounding the vertex of the quilt or fabric by hand as desired during stitching operations.

DETAILED DESCRIPTION

In the following detailed description of the illustrative embodiments, reference is made to the accompanying drawings that form a part hereof. These embodiments are described in sufficient detail to enable those skilled in the art to make and practice the invention, and it is understood that other embodiments may be utilized and that logical structural and mechanical changes may be made without departing from the spirit or scope of the invention. To avoid detail not necessary to enable those skilled in the art to practice the embodiments described herein, the description may omit certain information known to those of skill in the art. The following written description is, therefore, not to be taken in a limiting sense, and the scope of the illustrative embodiments are defined only by the appended claims.

Figure 1:
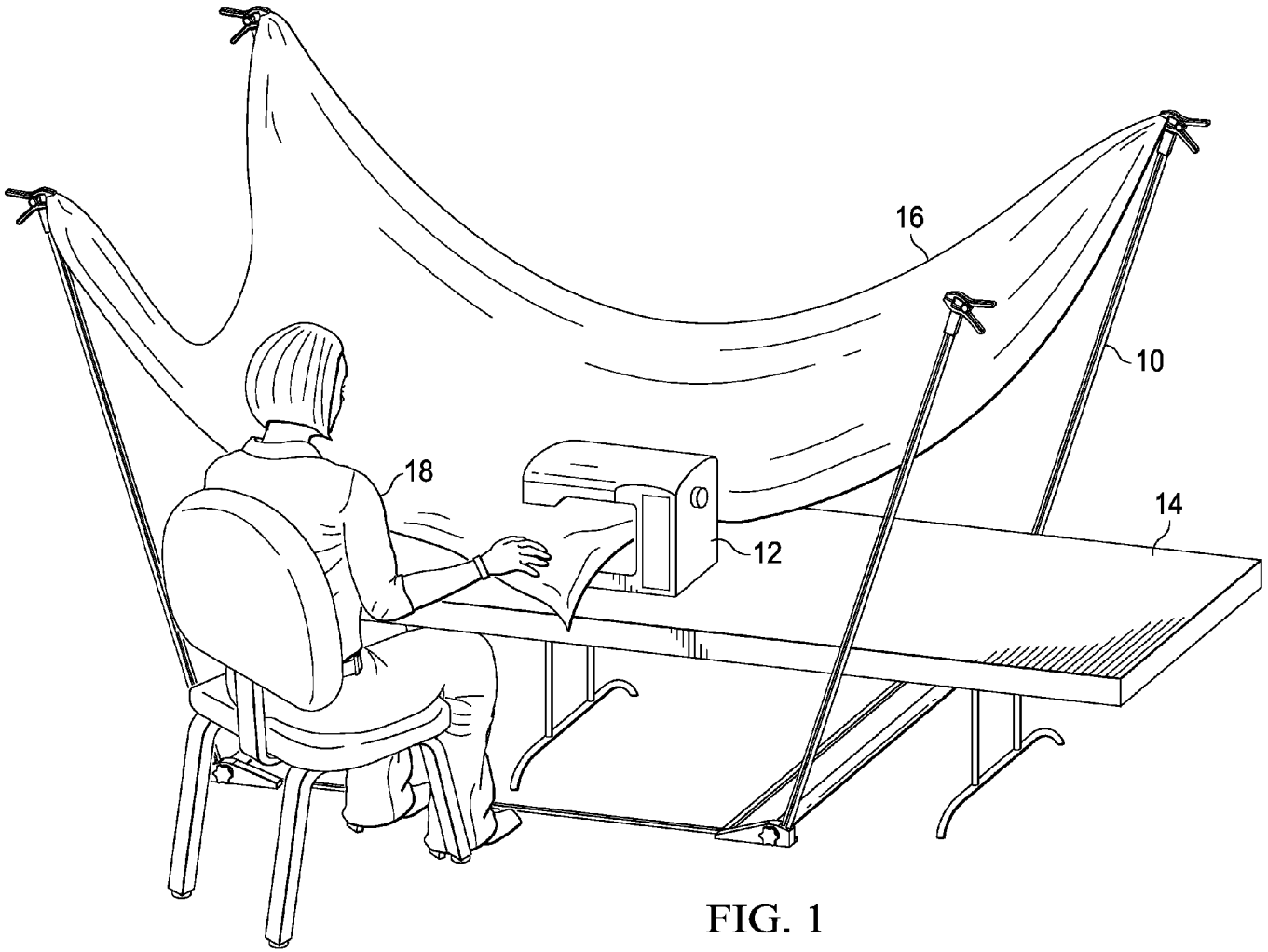
FIG. 1 is a perspective view of an operator seated at a sewing table showing an embodiment of the invention suspending a quilt or fabric to be stitched as described herein.

Turning to FIG. 1, the suspension assembly 10 is shown for suspending a quilt 16 or other fabric to be stitched by an operator 18 using "free motion" methods to stitch the quilt 16 with sewing machine 12 which is resting on table 14. It is understood that the suspension assembly 10 is capable of supporting a variety of fabrics or other materials which may be stitched and the depiction or references to quilts in this disclosure is not to be construed as limiting the claims, utility or uses of the invention to just quilts or quilting operations. In the depicted embodiment, the operator 18 has positioned quilt 16 so that the desired area for stitching is in relative position with needle of sewing machine 12. As the operator 18 moves quilt 16 by hand, the suspension assembly poles may flex to allow the operator 18 to move the quilt 16 as appropriate relative to the needle of sewing machine 12 during stitching operation without requiring the operator 18 to detach and and reattach portions of the quilt 16 each time stitching operations require relocation of the quilt 16 relative to the needle of sewing machine 12. As shown, the suspension assembly 10 allows the operator 18 to easily and "freely" move the quilt 16 in relative position to sewing machine 12 without having to use undue force or pressure to overcome the friction and weight of quilt 16 which would be generated quilt 16 was simply draped over and the edges of table 14.

Figure 2:
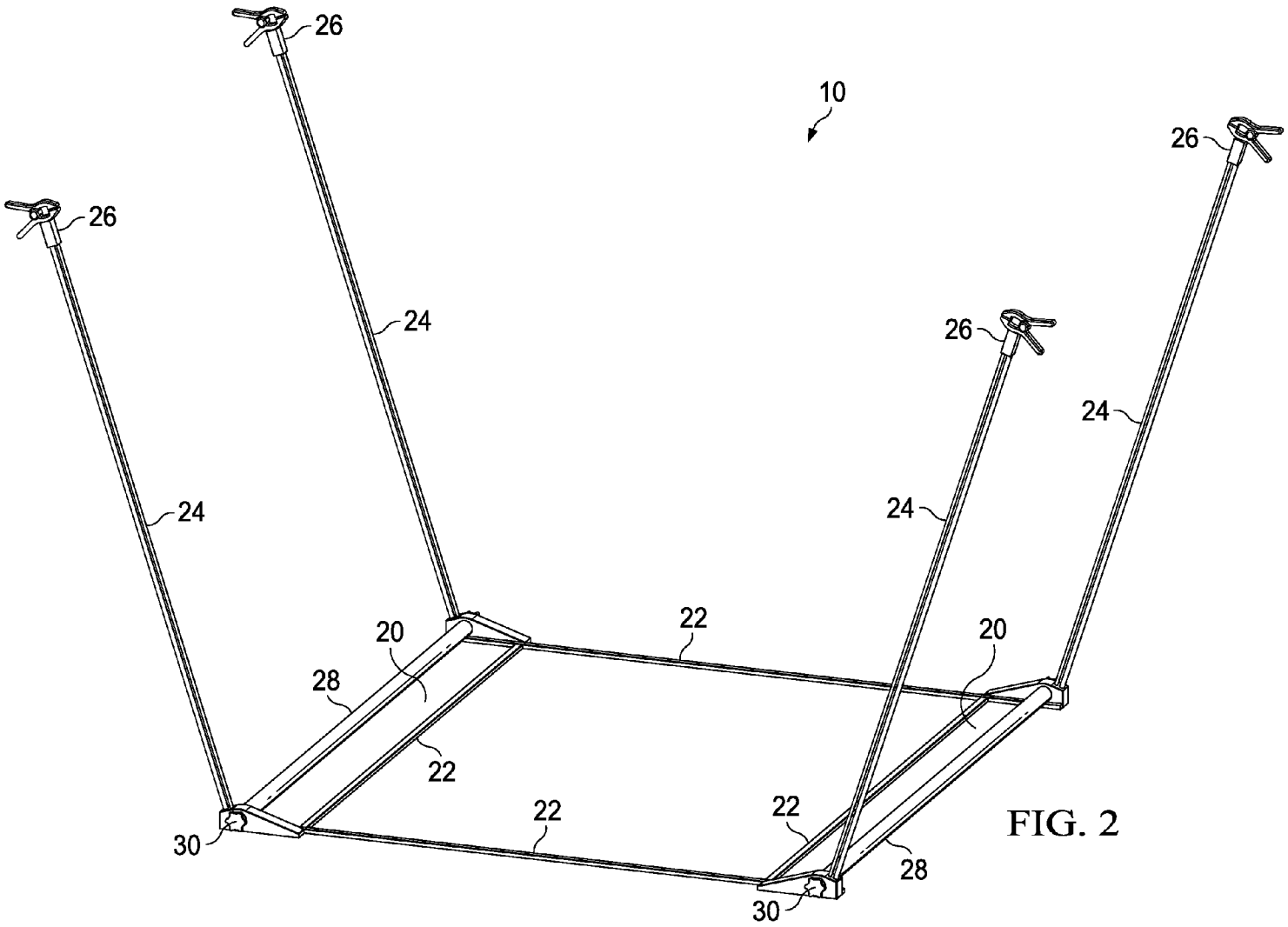
FIG. 2 is a perspective view of an embodiment of the invention depicting the suspension frame device as described herein; and, FIG. 3 depicts a view of an embodiment of a retention assembly attached to the support poles as described herein.

Referring to FIG. 2, the suspension assembly 10 is shown with its various component parts. Suspension assembly 10 comprises at least two frame bases 20. Frame base 20 is attached to braces 22 which attach to the opposing frame base 20 in a substantially rectangular shape. Braces 22 run parallel and perpendicular to each frame brace 20 and provide structural support to the frame assembly 10 and maintain dimensional spacing of each frame base 20 during placement of the suspension assembly 10 by the operator 18 in various setup environments. Frame base 20, braces 22 and poles 24 may be made of metal, plastic, fiberglass, wood or other suitable materials capable of providing appropriate rigidity and structural support for the suspension assembly 10. Poles 24 are securably detached attached to frame base 20 being inserted into orifices formed into a frame foot 32 depicted in FIG. 4 as shown. In contemplated embodiments, one or multiple poles 28 may be used to provide desired rigidity and flexibility to enable the operator 18 to easily move the suspended quilt or fabric 16 as desired relative to the needle area of sewing machine 12 during free-motion quilting operations. At the opposing end of poles 24, a retention assembly 26 is attached which acts to provide a mechanism by which a quilt or fabric 16 or other fabric may be detachably secured and held in place during free-motion quilting operations as described herein. Knob 30 is in mechanical communication with dowel 28 and allows the operator 18 to easily attach and detach the opposing frame feet during setup and breakdown of the suspension assembly 10.

Figure 3:
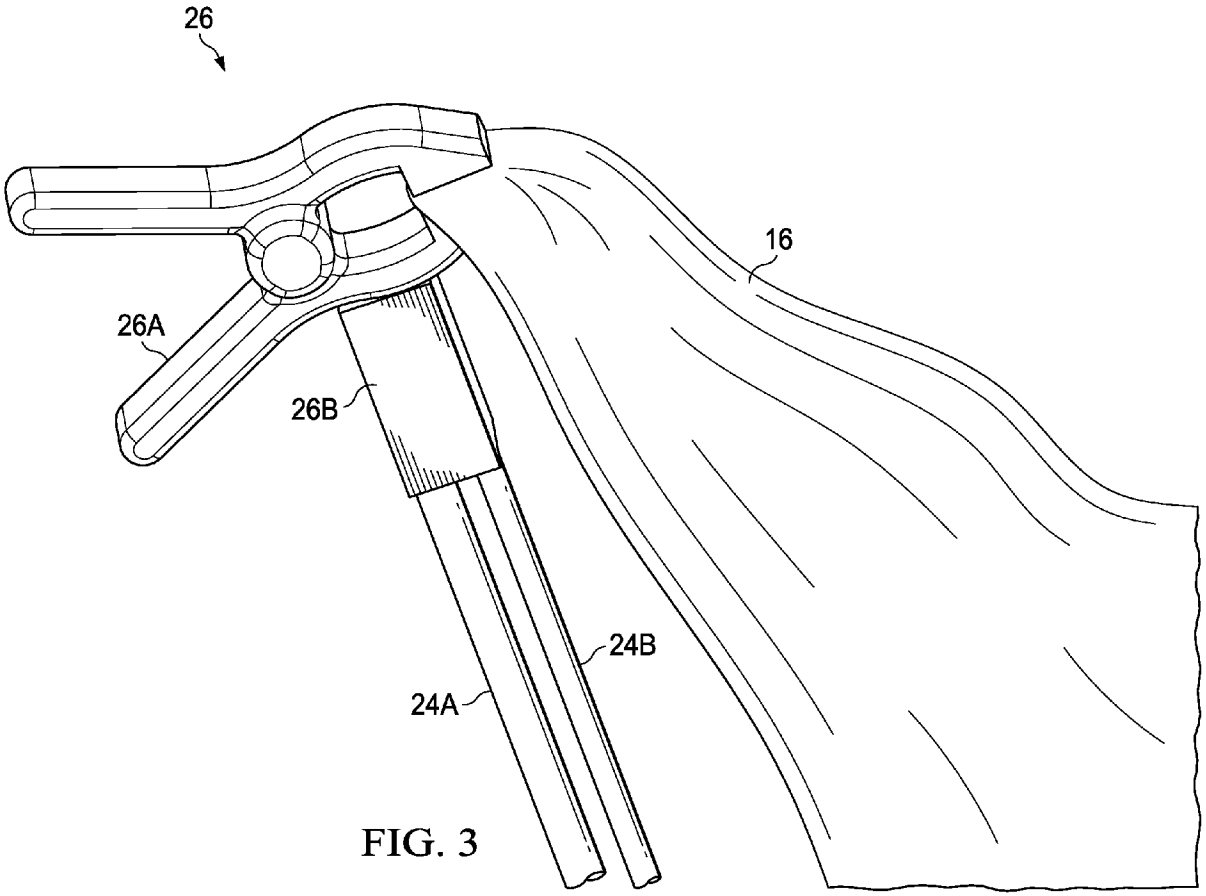

Referring now to FIG. 3, a close up view of the retention assembly 26 is depicted. Retention assembly 26 includes retainer 26A secured to retainer block 26B which includes one or more orifices (not shown) into which major and minor poles 24A, 24B are inserted to secure retention assembly 26 to the suspension apparatus 10 via major and minor poles 24A, 24B. In an embodiment, retainer 26A is a clip with opposing jaws. As depicted, a portion of quilt or fabric 16 is secured to retention assembly 26 by the jaws of clip retainer 26A. It is contemplated that other means for retaining a portion of quilt or fabric 16 may be used such as hooks, hook and loop fasteners, vise grips, clamps or magnetic fasteners as are commonly known in the art. In other contemplated embodiments, retention assembly 26 may be securably detached from the end portion of major and minor poles 24A, 24B and secured at various positions along the length of major and minor poles 24A, 24B by attachment means as are known in the art such has hook and loop fasteners, clamps, clips, vice grips or magnetic fasteners. In other contemplated embodiments, major and minor poles 24A, 24B may comprise various diametrical size and axial lengths, as well as be manufactured from wood, metal, fiberglass, plastic or other materials which provide sufficient strength and rigidity for the purposes described herein.

Figure 4:
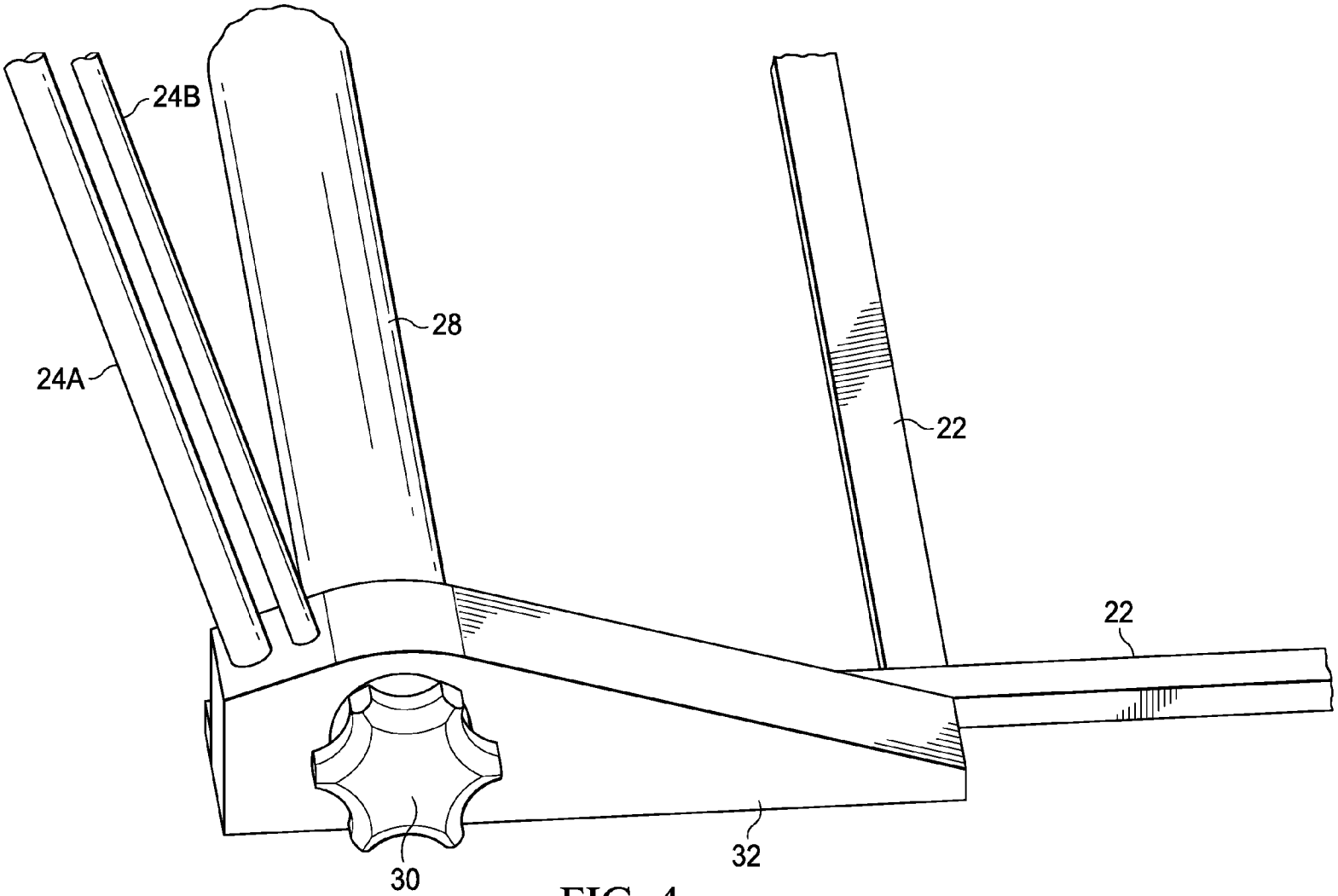
FIG. 4 is a perspective view of an embodiment of the frame, frame foot, and rotator as described herein.

FIG. 4 is a perspective view of a portion of the frame base 20, with braces 22, major and minor poles 24A, 24B, dowel 28, knob 30 and frame foot 32. As previously described herein, braces 22 provide lateral support for the frame base 20 and connect opposing frame bases 20 together in the desired spatial orientation from each other. Dowel 28 is secured to opposing frame feet 32 with threaded knobs 30 as shown. Frame feet 32 provide support for the frame base 20 at each opposing end of frame base 20 and also provides an attachment point and support for poles 24A, 24B as shown. Suspension assembly 10 is easily assembled for use and disassembled for transport to new locations.

Figure 5:
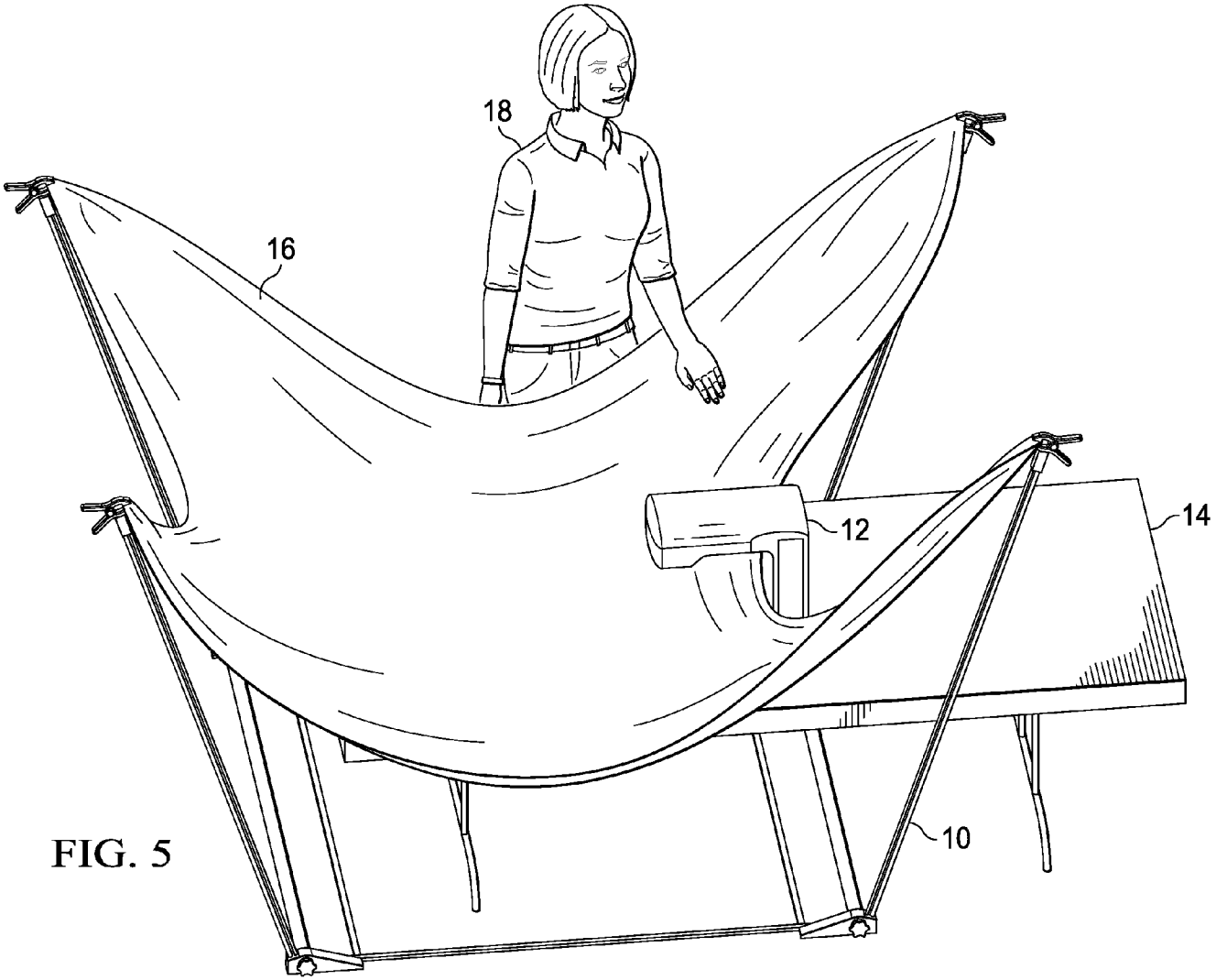
FIG. 5 is a perspective view of an embodiment of the present invention showing a quilt or other fabric to be stitched suspended above the sewing table for free-motion quilting as described herein.
Figure 6:
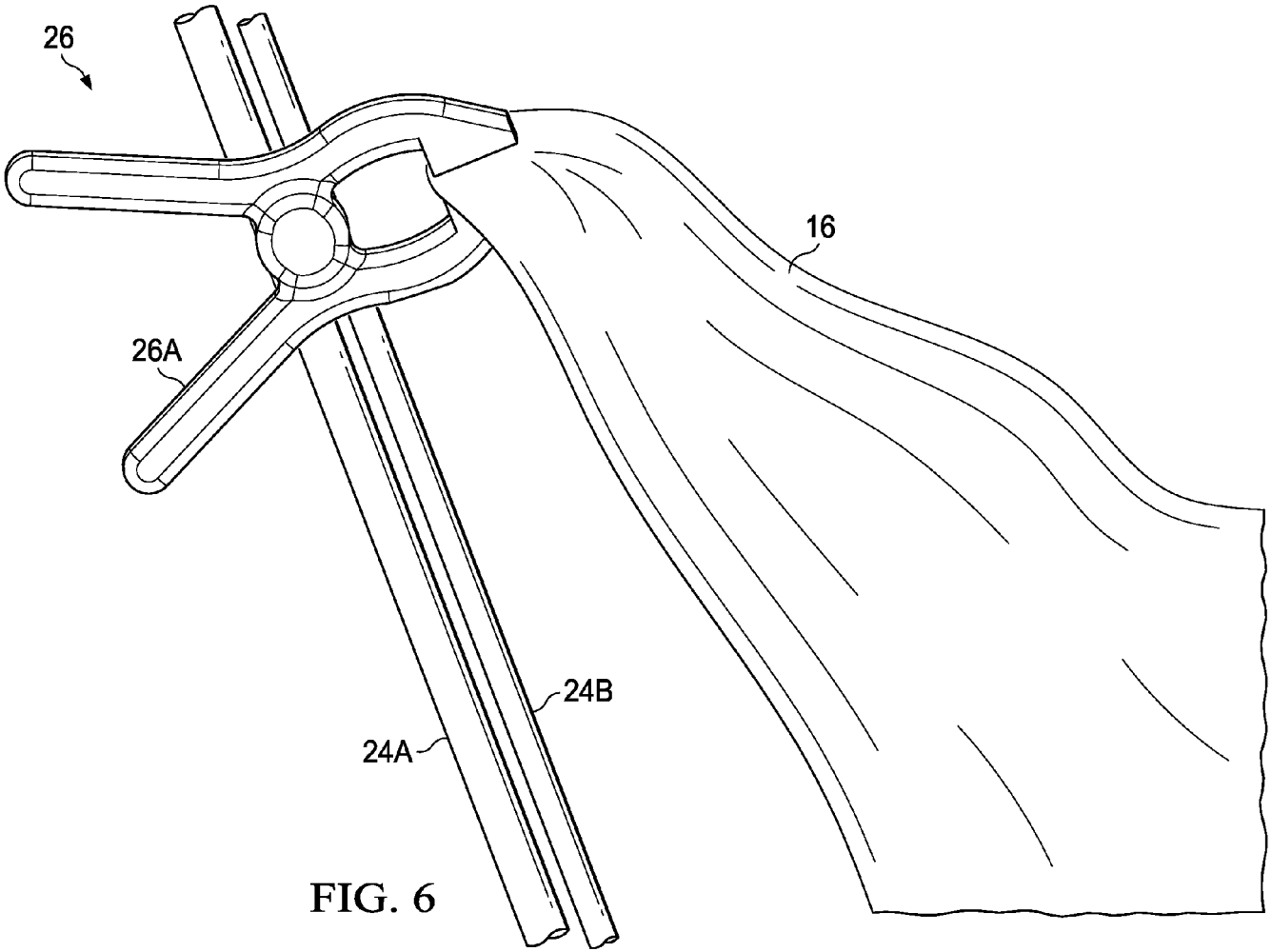
FIG. 6 is schematic diagram of a retention assembly secured at an intermediate position on a pole as described below.

Turning to FIG. 5, suspension assembly 10 is shown in a typical setup. Operator 18 has assembled the suspension assembly 10 as previously described herein and has completed attaching the quilt or fabric 16 to suspension assembly 10. In this depiction, the quilt or fabric 16 is substantially suspended above table 14 thereby preventing the substantial restriction of movement of the quilt or fabric 16 as would be encountered if the quilt or fabric 16 were simply laid on the table 14 and spilling over the edges of the table 14.

Although the illustrative embodiments described herein have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

We claim:

1. A method for suspending a fabric for free-motion quilting by an operator of a sewing machine having a needle, wherein the sewing machine is supported on a surface, the method comprising:

providing a suspension assembly for suspending the fabric;

wherein the suspension assembly comprises: spaced apart frame bases, each frame base with a frame foot at opposing ends of the spaced apart frame bases and at least one pole secured to each frame foot with a retention assembly attached to the opposing end of the pole;

orienting the suspension assembly in relative proximity to the surface supporting the sewing machine; and attaching a portion of the fabric to the suspension assembly with at least one retention assembly to form a partial paraboloid shape with a vertex in close proximity to the needle of the sewing machine so as to allow the needle to operate without interference from the rest of the fabric.

2. The method of claim 1, further comprising flexing the at least one pole to move a portion of the fabric forming the vertex in contact with the needle of the sewing machine.

3. The method of claim 1 further comprising:

moving the at least one retention assembly along the length of the at least one pole.

4. The method of claim 1 further comprising:

securing one or more additional poles to one or more frame feet to increase the rigidity of the suspension assembly.

5. A method of sewing a top layer and a bottom layer of fabric together with a batting layer therebetween using a sewing machine having a needle, the method comprising:

providing a suspension assembly comprising:

a first frame base, a second frame base, a brace coupled to the first frame base and the second frame base, a first frame foot coupled to the first frame base, a second frame foot coupled to the first frame base, a third frame foot coupled to the second frame base, a first pole coupled to the first frame foot, a second pole coupled to the second frame foot, a third pole coupled to the third frame foot, and a plurality of retention assemblies coupled to the first pole, the second pole, and third pole for selectably holding fabric;

disposing the sewing machine above the first frame foot, the second frame foot, and the third frame foot and below at least a portion of the first pole, the second pole, and the third pole;

disposing the top layer of fabric, the bottom layer of fabric, and the batting over at least a portion of the sewing machine;

releasably coupling the top layer of fabric, the bottom layer of fabric, and the batting layer to the suspension assembly with the plurality of retention assemblies whereby the top layer of fabric, the bottom layer of fabric, and the batting layer are supported by the first pole, second pole, and third pole, and sag to form a vertex immediately proximate the needle of the sewing machine; and sewing the top layer of fabric, the bottom layer of fabric, and the batting layer together.

* * * * *